US008714638B2

(12) United States Patent
Hoffman et al.

(10) Patent No.: US 8,714,638 B2
(45) Date of Patent: May 6, 2014

(54) HIGH LEG RECLINING SEATING UNIT WITH EXTENDABLE FOOTREST

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 81 days.

(21) Appl. No.: 13/366,556

(22) Filed: Feb. 6, 2012

(65) Prior Publication Data

US 2013/0200658 A1 Aug. 8, 2013

(51) Int. Cl.
*A47C 1/035* (2006.01)

(52) U.S. Cl.
USPC ..... 297/85 L; 297/83; 297/84; 297/85 R

(58) Field of Classification Search
USPC ..... 297/83, 84, 85 R, 85 M, 85 L
See application file for complete search history.

(56) References Cited

U.S. PATENT DOCUMENTS 4,989,914 A * 2/1991 Pine ..... 297/85 L
5,087,094 A * 2/1992 Rogers, Jr. ..... 297/85 R X
5,090,768 A * 2/1992 Re et al. ..... 297/85 L
5,110,179 A * 5/1992 Rogers ..... 297/85 R X
5,169,208 A * 12/1992 Re et al. ..... 297/85 L
5,354,116 A * 10/1994 May et al. ..... 297/85 L
5,374,101 A * 12/1994 Wiecek ..... 297/85 R
5,480,213 A * 1/1996 Sproule ..... 297/85 R X
5,772,278 A * 6/1998 Kowalski ..... 297/85 L
5,775,775 A * 7/1998 Hoffman ..... 297/85 R X
5,800,010 A * 9/1998 May ..... 297/85 L
5,823,614 A * 10/1998 Johnson et al. ..... 297/84 X
5,975,627 A * 11/1999 LaPointe et al. ..... 297/83 X
5,992,930 A * 11/1999 LaPointe et al. ..... 297/83 X
6,089,660 A * 7/2000 Sproule ..... 297/85 R X
6,142,558 A * 11/2000 May ..... 297/85 R X
6,540,291 B2 * 4/2003 Hoffman et al. ..... 297/85 R
6,729,686 B2 * 5/2004 May ..... 297/84
6,793,279 B2 * 9/2004 Hoffman et al. ..... 297/84
7,357,450 B2 * 4/2008 Rogers ..... 297/83 X
7,396,074 B2 * 7/2008 Wiecek ..... 297/85 L
7,445,278 B2 * 11/2008 Wiecek ..... 297/83 X
7,594,694 B2 * 9/2009 Wiecek ..... 297/83 X
7,641,277 B2 * 1/2010 Lawson et al. ..... 297/85 L
7,669,921 B2 * 3/2010 Hoffman et al. ..... 297/84 X
7,669,922 B2 * 3/2010 Murphy et al. ..... 297/85 R
7,673,933 B2 * 3/2010 Lawson ..... 297/85 M X
7,762,625 B2 * 7/2010 Hoffman et al. ..... 297/85 L
7,766,421 B2 * 8/2010 Lawson ..... 297/85 R
7,997,644 B2 * 8/2011 Hoffman et al. ..... 297/85 M (Continued)

*Primary Examiner* — Rodney B White
(74) *Attorney, Agent, or Firm* — Myers Bigel Sibley & Sajovec, P.A.

(57) ABSTRACT

A reclining seating unit includes: a base that rests on an underlying surface; a seat; a backrest; an ottoman; and a reclining mechanism comprising a plurality of pivotally interconnected links and attached to the base, seat, backrest and ottoman. The reclining mechanism moves the seat, backrest and ottoman relative to the base between (a) an upright position, wherein the backrest is generally upright, the seat is generally horizontal, and the ottoman is positioned beneath the seat and faces generally downwardly, (b) a TV position, wherein the backrest is generally upright and the ottoman is generally horizontally disposed in front of the seat, and (c) a fully reclined position, wherein the ottoman remains generally horizontally disposed in front of the seat and the backrest takes a shallower angle relative to the seat than in the upright and TV positions. The ottoman is between about 8 and 12 inches in length.

19 Claims, 14 Drawing Sheets

(56) References Cited

U.S. PATENT DOCUMENTS

| | | | | |
|---|---|---|---|---|
| 8,016,348 | B2 * | 9/2011 | Hoffman et al. | 297/85 M |
| 8,113,574 | B2 * | 2/2012 | Hoffman et al. | 297/85 M |
| 8,123,288 | B2 * | 2/2012 | Murphy et al. | 297/85 R |
| 8,297,693 | B2 * | 10/2012 | Hoffman et al. | 297/85 M |
| 8,360,515 | B2 * | 1/2013 | Crum | 297/85 R |
| 8,398,165 | B2 * | 3/2013 | Lawson | 297/85 M |
| 8,419,122 | B2 * | 4/2013 | Lawson et al. | 297/85 M |
| 8,459,733 | B2 * | 6/2013 | Hoffman et al. | 297/85 M |
| 2003/0057743 | A1 * | 3/2003 | May | 297/84 |
| 2006/0290174 | A1 * | 12/2006 | Hoffman et al. | 297/84 |
| 2007/0126267 | A1 * | 6/2007 | Hoffman et al. | 297/84 |
| 2010/0264702 | A1 * | 10/2010 | Hoffman et al. | 297/83 X |
| 2010/0283297 | A1 * | 11/2010 | Crum | 297/84 |
| 2011/0175426 | A1 * | 7/2011 | Lawson | 297/85 M |
| 2011/0233972 | A1 * | 9/2011 | Weicek | 297/84 |
| 2011/0291460 | A1 * | 12/2011 | Murphy et al. | 297/85 M |
| 2011/0304193 | A1 * | 12/2011 | Murphy et al. | 297/85 M |
| 2012/0049606 | A1 * | 3/2012 | Lawson et al. | 297/85 M |
| 2012/0104827 | A1 * | 5/2012 | Murphy et al. | 297/85 M |
| 2012/0112519 | A1 * | 5/2012 | Murphy et al. | 297/85 M |
| 2012/0146364 | A1 * | 6/2012 | Hoffman et al. | 297/84 |
| 2012/0153704 | A1 * | 6/2012 | Hoffman et al. | 297/85 M |
| 2012/0235449 | A1 * | 9/2012 | Wiecek | 297/84 |
| 2012/0299363 | A1 * | 11/2012 | Crum | 297/85 M |
| 2013/0038095 | A1 * | 2/2013 | Lawson et al. | 297/83 |

* cited by examiner

HIGH LEG RECLINING SEATING UNIT WITH EXTENDABLE FOOTREST

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest or ottoman that provides support for the occupant's feet in the reclined position.

One particularly popular recliner is the "three-way" recliner, which has two reclined positions: an intermediate "TV position", in which the footrest or ottoman of the chair is projected forwardly from the chair while the backrest remains substantially upright relative to the seat; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position, and from a "one-way" recliner, which typically has no intermediate "TV" position.

Early in the development of recliners, chair styles tended to be bulky, which limited the popularity of the recliner somewhat. Consumers have begun to demand reclining capability for less bulky chairs. Examples of sleeker, more modern recliner styles are illustrated in U.S. Pat. No. 7,669,922 to Murphy et al and U.S. Pat. No. 7,762,625 to Hoffman et al, the disclosures of each of which is hereby incorporated herein in its entirety.

As chair styling continues to evolve, it may be desirable to provide additional headrest configurations.

SUMMARY OF THE INVENTION

As a first aspect, embodiments of the present invention are directed to a reclining seating unit. The seating unit comprises: a base configured to rest on an underlying surface; a seat; a backrest; an ottoman; and a reclining mechanism comprising a plurality of pivotally interconnected links and attached to the base, seat, backrest and ottoman. The reclining mechanism is configured to move the seat, backrest and ottoman relative to the base between (a) an upright position, in which the backrest is generally upright, the seat is generally horizontal, and the ottoman is positioned beneath the seat and faces generally downwardly, (b) a TV position, in which the backrest is generally upright and the ottoman is generally horizontally disposed in front of the seat, and (c) a fully reclined position, in which the ottoman remains generally horizontally disposed in front of the seat and the backrest takes a shallower angle relative to the seat than in the upright and TV positions. The ottoman is between about 8 and 12 inches in length.

As a second aspect, embodiments of the present invention are directed to a reclining seating unit, comprising: a base configured to rest on an underlying surface; a seat; a backrest; an ottoman; and a reclining mechanism comprising a plurality of pivotally interconnected links and attached to the base, seat, backrest and ottoman. The reclining mechanism is configured to move the seat, backrest and ottoman relative to the base between (a) an upright position, in which the backrest is generally upright, the seat is generally horizontal, and the ottoman is positioned beneath the seat and faces generally downwardly, (b) a TV position, in which the backrest is generally upright and the ottoman is generally horizontally disposed in front of the seat, and (c) a fully reclined position, in which the ottoman remains generally horizontally disposed in front of the seat and the backrest takes a shallower angle relative to the seat than in the upright and TV positions. The lowermost point of the ottoman is at least 6 inches from the underlying surface when the seating unit is in the upright position:

As a third aspect, embodiments of the present invention are directed to a reclining seating unit, comprising: a base configured to rest on an underlying surface; a seat; a backrest; an ottoman; and a reclining mechanism comprising a plurality of pivotally interconnected links and attached to the base, seat, backrest and ottoman. The reclining mechanism is configured to move the seat, backrest and ottoman relative to the base between (a) an upright position, in which the backrest is generally upright, the seat is generally horizontal, and the ottoman is positioned beneath the seat and faces generally downwardly, (b) a TV position, in which the backrest is generally upright and the ottoman is generally horizontally disposed in front of the seat, and (c) a fully reclined position, in which the ottoman remains generally horizontally disposed in front of the seat and the backrest takes a shallower angle relative to the seat than in the upright and TV positions. The reclining mechanism includes a footrest linkage that comprises: front and rear ottoman drive links pivotally attached to the seat; a rear ottoman extension link pivotally attached to the front and rear ottoman drive links; an auxiliary ottoman extension link pivotally attached to the rear ottoman drive link; an auxiliary ottoman bracket pivotally attached to the auxiliary ottoman extension link and to the rear ottoman extension link; a main ottoman extension link pivotally attached to the auxiliary ottoman bracket; and a main ottoman bracket to which the ottoman is mounted, the main ottoman bracket being pivotally attached to the rear ottoman extension link and to the main ottoman extension link.

DETAILED DESCRIPTION OF EMBODIMENTS OF THE INVENTION

Figure 1:
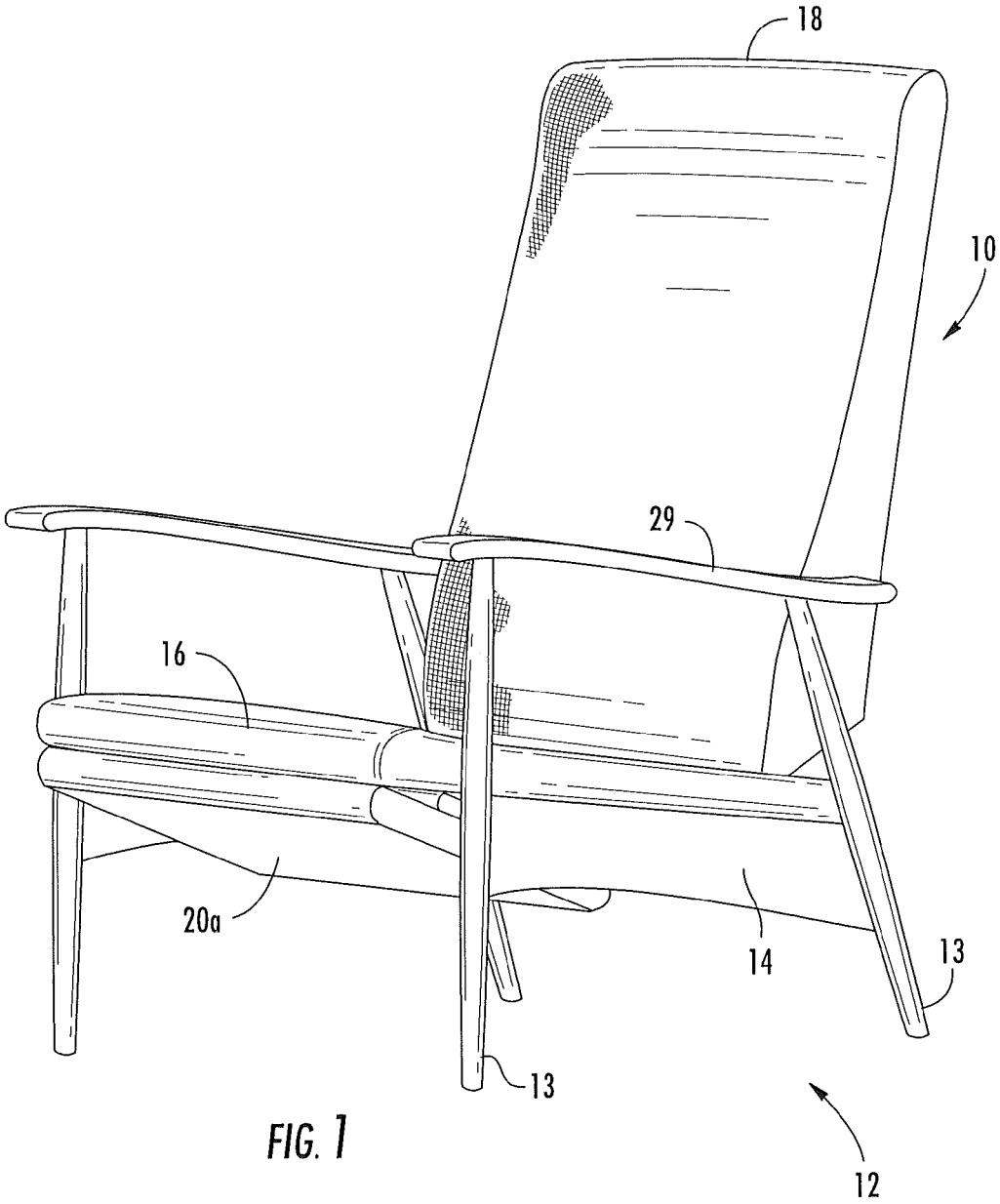
FIG. 1 is a perspective view of a reclining chair according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention.

Also, the shapes and configurations of the links themselves may vary, as will be understood by those skilled in this art. Further, some links may be omitted entirely in some embodiments, and additional links may be included in some embodiments.

Referring now to the figures, a reclining chair, designated broadly at 10, is illustrated in FIG. 1. The chair includes a frame 12 that rests on an underlying surface (e.g., the floor), a seat 16, a backrest 18, and main and auxiliary ottomans 20*a*, 20*b* (only the main ottoman 20*a* is visible in FIG. 1). These structures are interconnected with a pair of reclining mechanisms 21 (see FIG. 4). These components are discussed in greater detail below.

Figure 5:
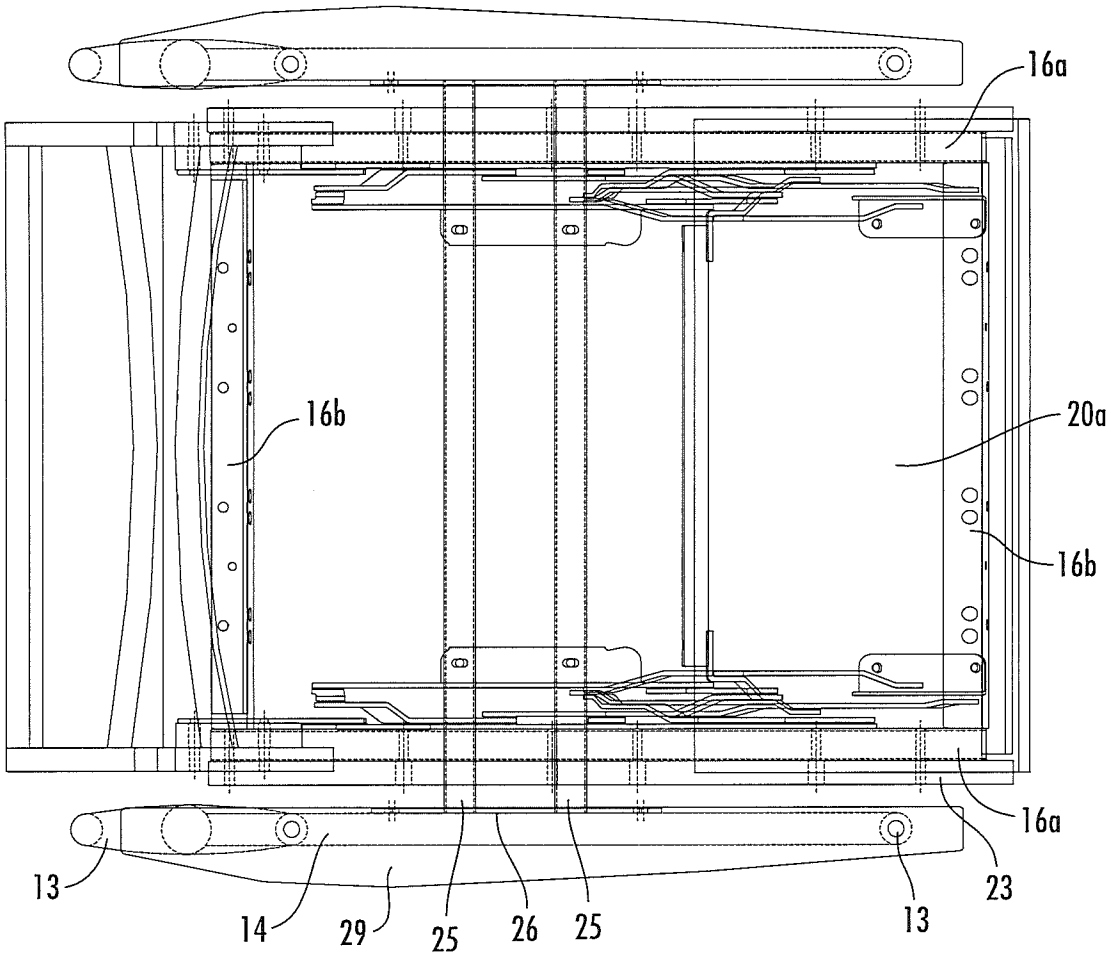
FIG. 5 is a cutaway top view of the chair of FIG. 1 showing the chair in its upright position.

Referring now to FIG. 5, the frame 12 includes four legs 13, with pairs of legs 13 on each side of the chair 10 being spanned by arm panels 14 and arms 29. Arm brackets 26 are mounted to the inboard surfaces of the arm panels 14. Two cross-members 25 are fixed at their outer ends to the arm brackets 26 to form a rigid unit between the arms 29. The lower edges of the arms panels 14 are between about 5 and 8 inches from the floor.

Still referring to FIG. 5, the seat 16 includes side rails 16*a* and cross-members 16*b*, which combine to form a generally square structure. A cushion (shown in FIG. 1) rests on the side rails 16*a* and cross-members 16*b*. A serpentine seat panel 84 is mounted to the inside of each side rail 16*a*, and a decorative panel 23 is mounted to the outer surface of each side rail 16*a*.

Turning now to the reclining mechanism 21, each of the reclining mechanisms 21 is a mirror image of the other reclining mechanism 21 about a vertical plane that extends from the front of the chair 10 to the rear and is centered between the arms 29. In the interest of brevity, only one reclining mechanism 21 will be described herein, with the understanding that the discussion is equally applicable to the other reclining mechanism 21. Also, the reclining mechanism 21 will be described first with respect to the fully reclined position (FIG. 4) in order to illustrate more easily the interconnection of the various links thereof.

Figure 4:
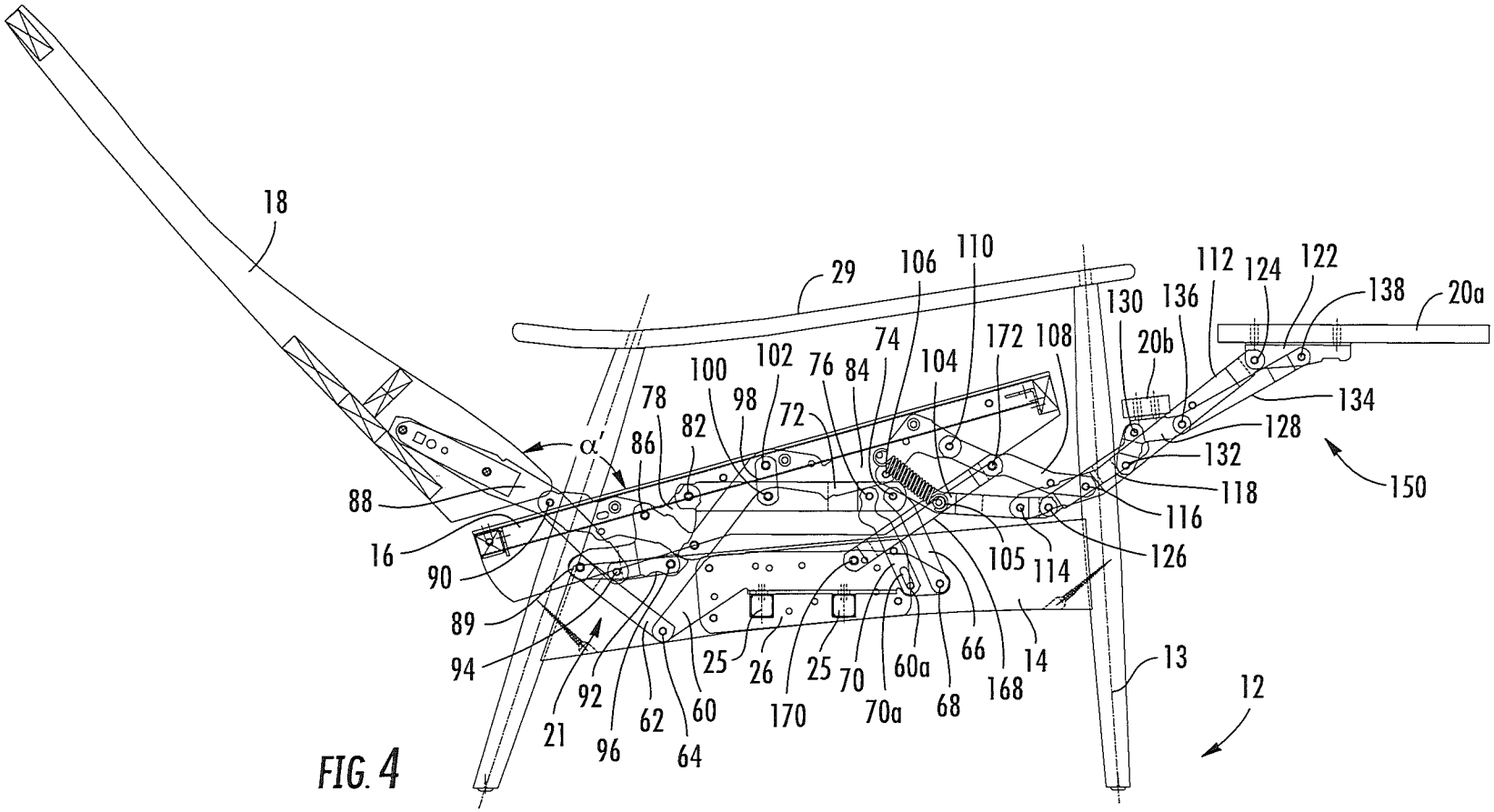
FIG. 4 is a cutaway side view of the chair of FIG. 1 showing the chair in its fully reclined position.

Referring to FIG. 4, the reclining mechanism 21 has an angled frame bracket 60 mounted to the upper surfaces of the cross-members 25. A rear swing link 62 is attached at its lower end to the frame bracket 60 at a pivot 64 and extends upwardly and rearwardly therefrom. A front swing link 66 is attached at its lower end to the frame bracket 60 at a pivot 68 and extends upwardly and slightly rearwardly therefrom. A sequencer link 70 is attached to the frame bracket 60 via a slot 70*a* that receives a pin 60*a* on the frame bracket 60. The sequencer link 70 extends upwardly and rearwardly to attach to a connector link 72 at a pivot 76; the front swing link 66 also attaches to the connector link 72 at a pivot 74. The connector link 72 extends substantially rearwardly from the pivot 76 to a pivot 82 with a transition plate 78. The transition plate 78, which has three fingers, is attached by its middle finger to the seat panel 84 at a pivot 86, and is also attached at its rear finger with the upper end of the rear swing link 62 at a pivot 89. A control link 98 is attached to the seat panel 84 at a pivot 102 and to the connector link 72 at a pivot 100.

Still referring to FIG. 4, an angled backpost 88 is fixed to the backrest 18 and extends downwardly and forwardly therefrom. At one of its interior vertices, the backpost 88 is attached to the seat panel 84 at a pivot 90. A drive link 92 is attached to the lower, forward end of the backpost 88 at a pivot 94 and extends forwardly therefrom to a pivot 96 with the lower portion of the transition plate 78.

Referring still to FIG. 4, a rear ottoman drive link 104 is attached at a pivot 106 to the seat panel 84 and extends forwardly therefrom. A spring 105 extends between the rear ottoman drive link 104 and the seat panel 84. A front ottoman drive link 108 is attached at a pivot 110 to the seat panel 84 at a pivot that is positioned forwardly and upwardly from the pivot 106. A rear ottoman extension link 112 is attached to the forward end of the front ottoman drive link 108 at a pivot 116 and extends forwardly and upwardly therefrom; the rear ottoman extension link 112 is also attached to an intermediate portion of the rear ottoman drive link 104 at a pivot 114. A main ottoman bracket 122, to which the main ottoman 20*a* is mounted, is attached to the forward end of the rear ottoman drive link 112 at a pivot 124. An auxiliary ottoman extension link 118 is attached to the front end of the rear ottoman drive link 104 and extends forwardly and slightly upwardly therefrom. An angled auxiliary ottoman bracket 128, to which the auxiliary ottoman 20*b* is mounted, is attached at its vertex to the forward, tabbed end of the auxiliary extension link 118 at a pivot 130 and to the rear ottoman extension link 112 at a pivot 132. A main ottoman extension link 134 is attached to the forward end of the auxiliary ottoman bracket 128 at a pivot 136 and extends forwardly and upwardly therefrom to a pivot 138 with the main ottoman bracket 122. Thus, these links 104, 108, 112, 118, 122, 128 and 134 comprise a footrest linkage 150 that serves to extend and retract the ottomans 20*a*, 20*b*.

A drive link 168 is attached to the front ottoman drive link 108 at a pivot 172, and extends rearwardly therefrom to a pivot 170 with the frame mounting bracket 60.

Figure 2:
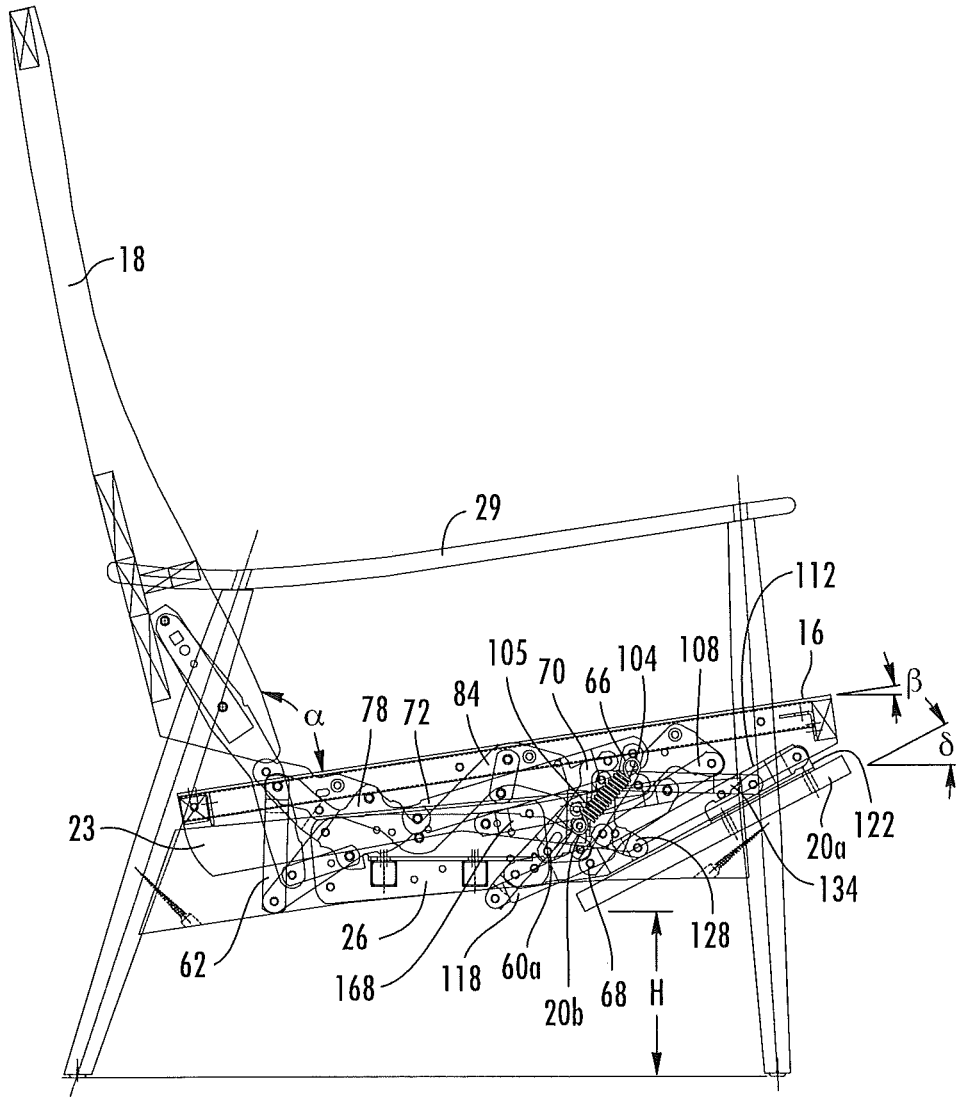
FIG. 2 is a cutaway side view of the chair of FIG. 1 showing the chair in its upright position.
Figure 6:
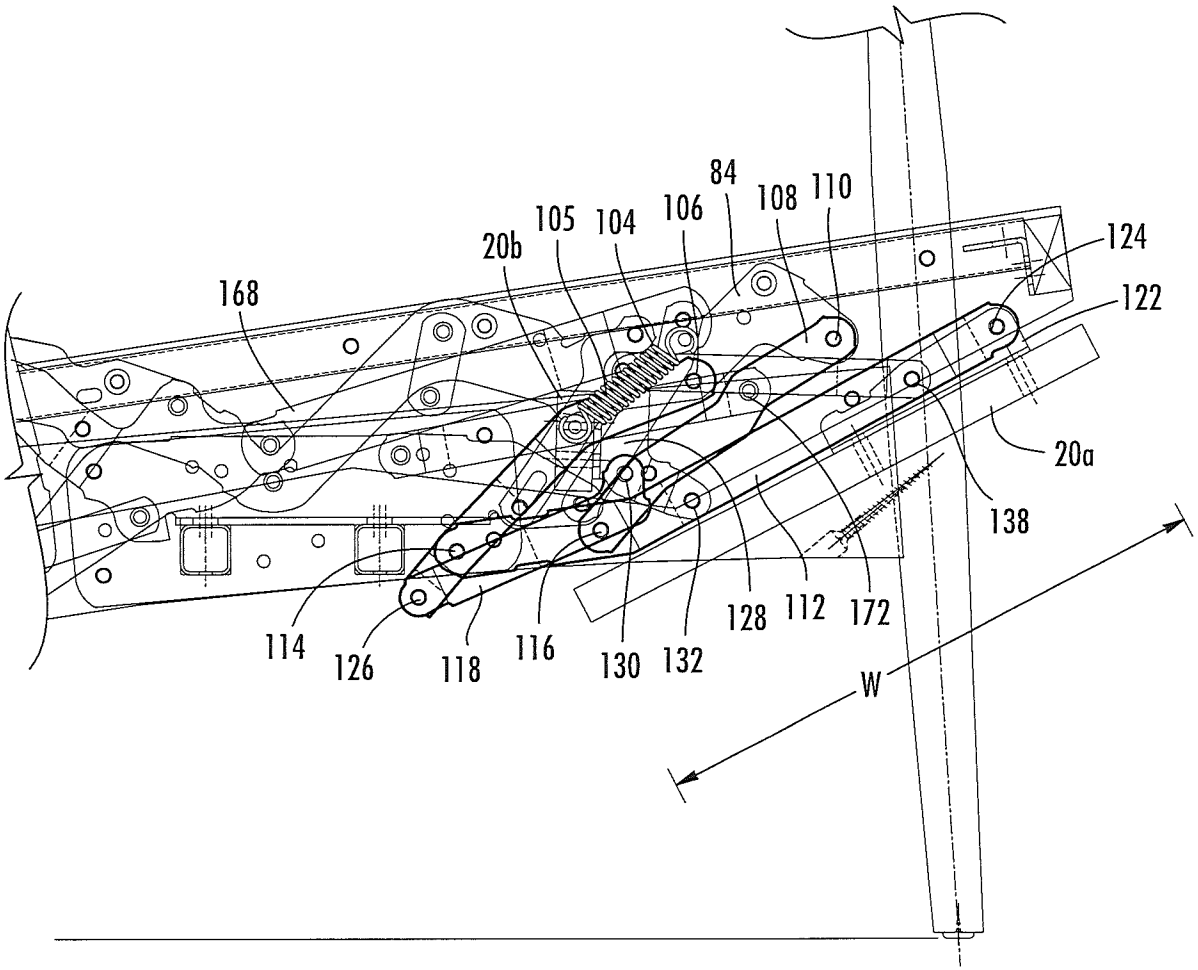
FIGS. 6-14 are enlarged cutaway views showing the movement of the main and auxiliary ottomans as the chair of FIG. 1 moves from the upright position to the TV position.
Figure 7:
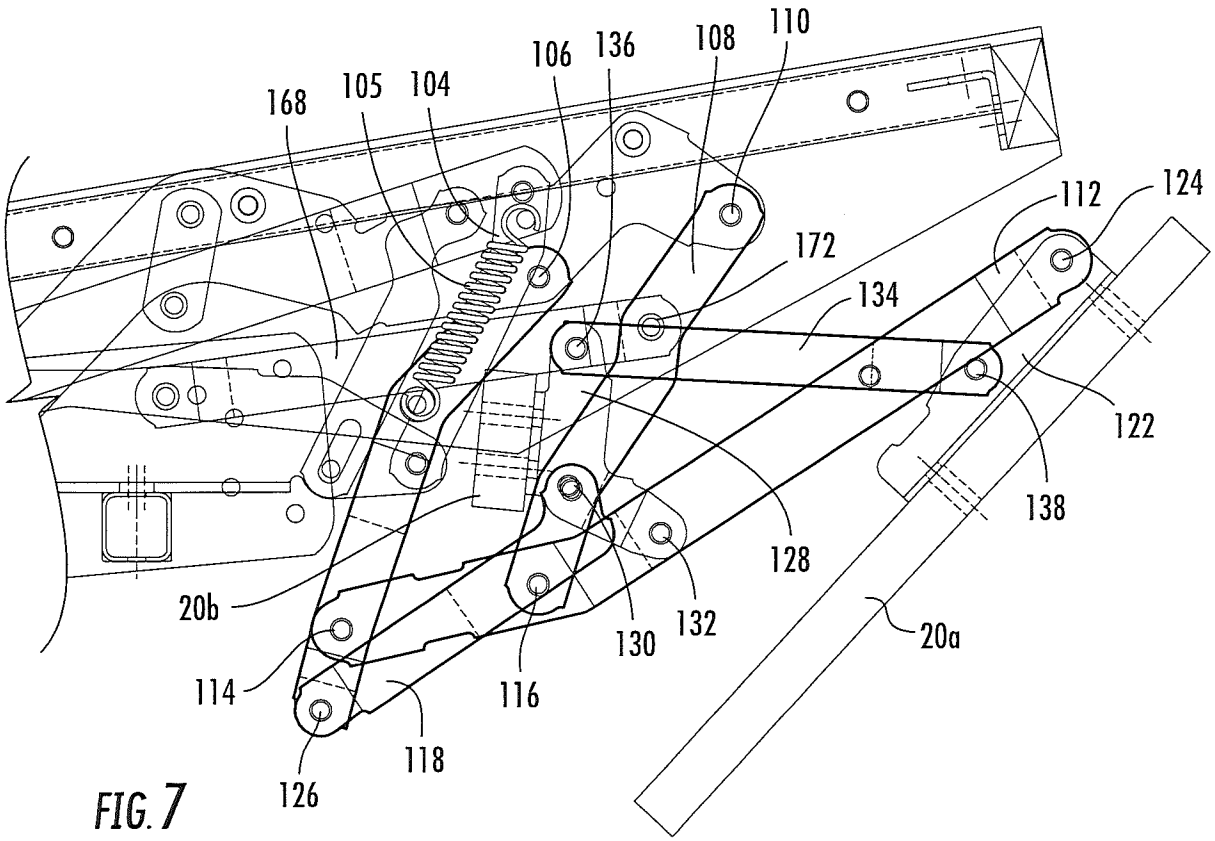
Figure 8:
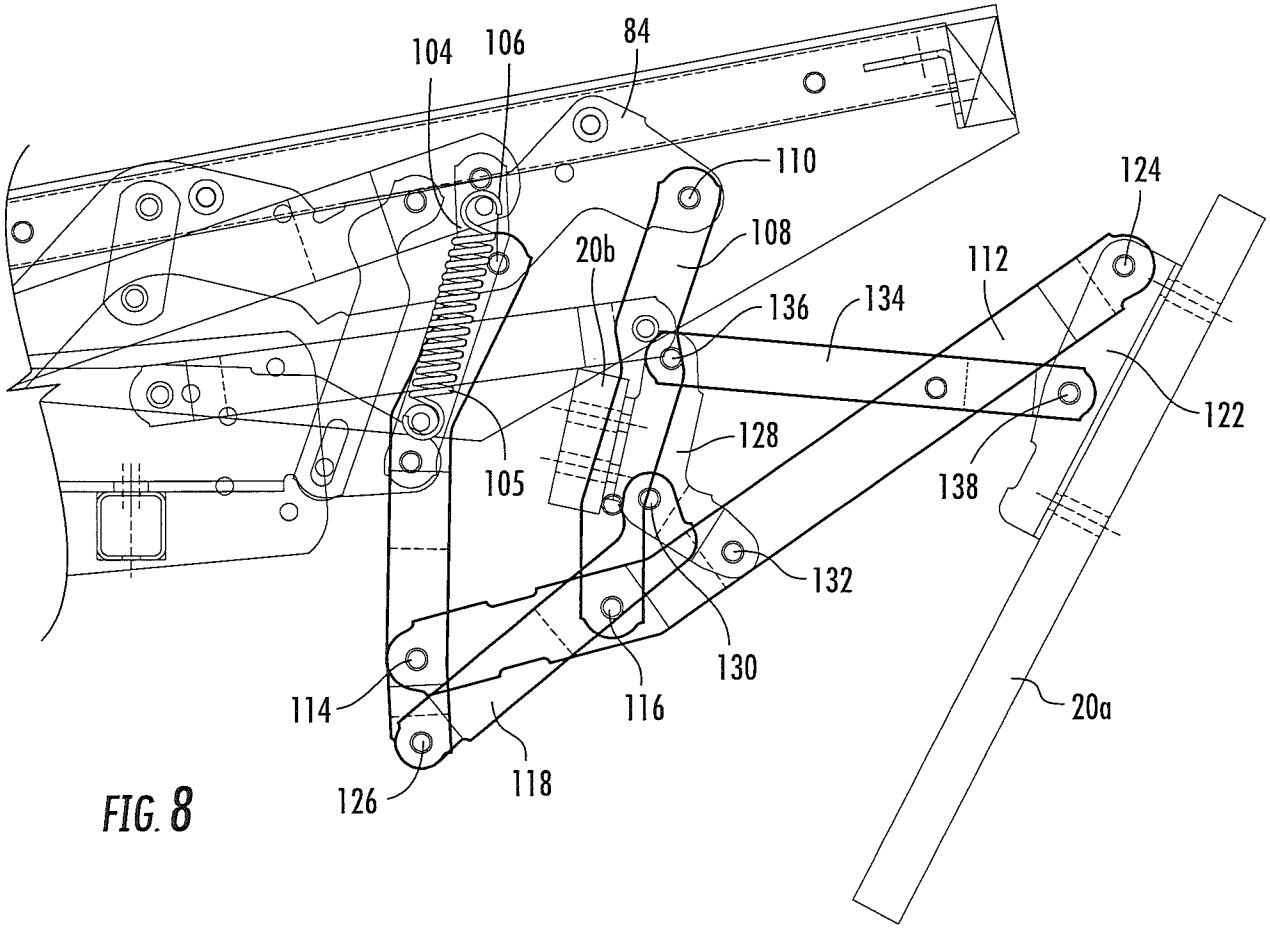
Figure 9:
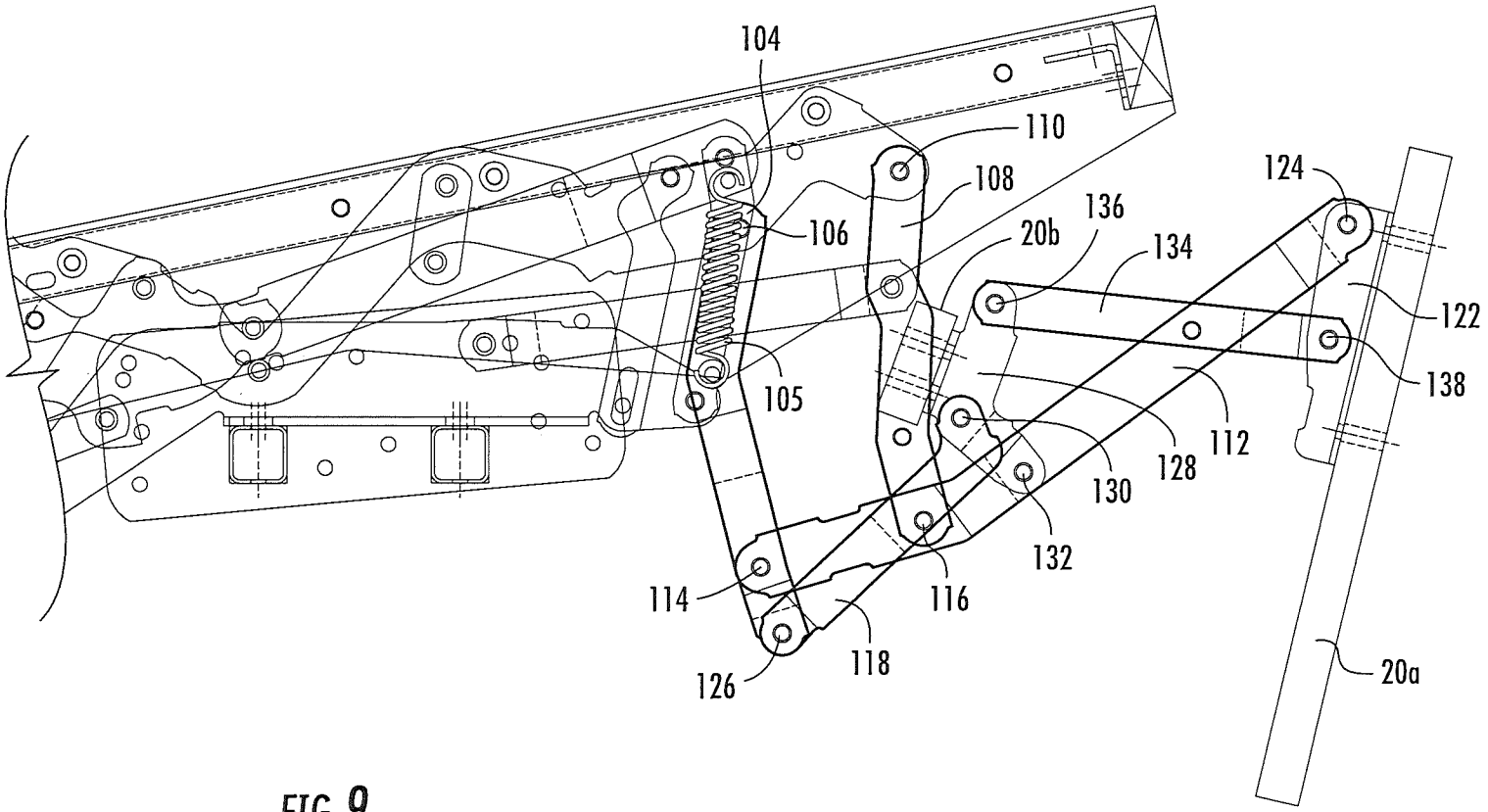
Figure 10:
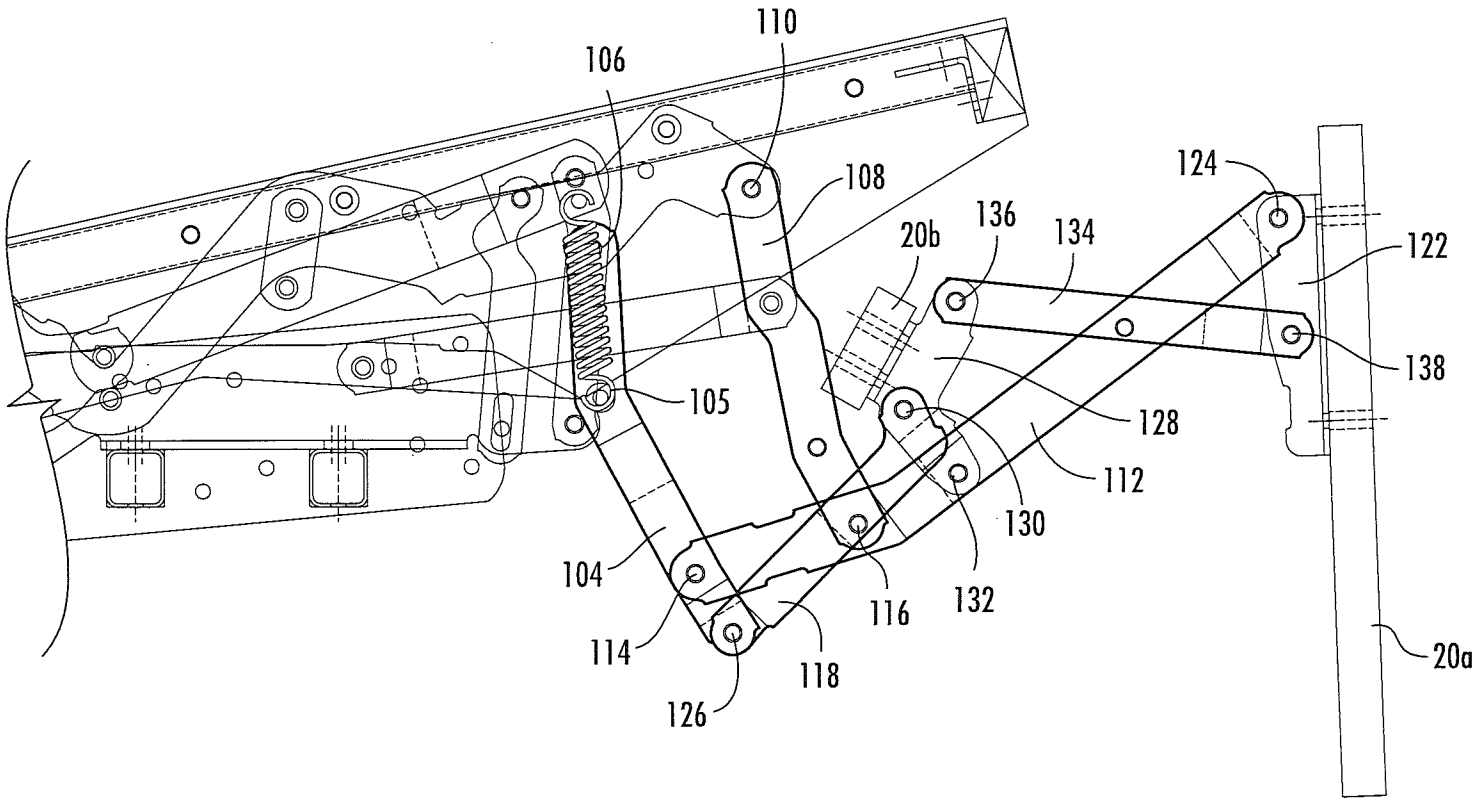
Figure 11:
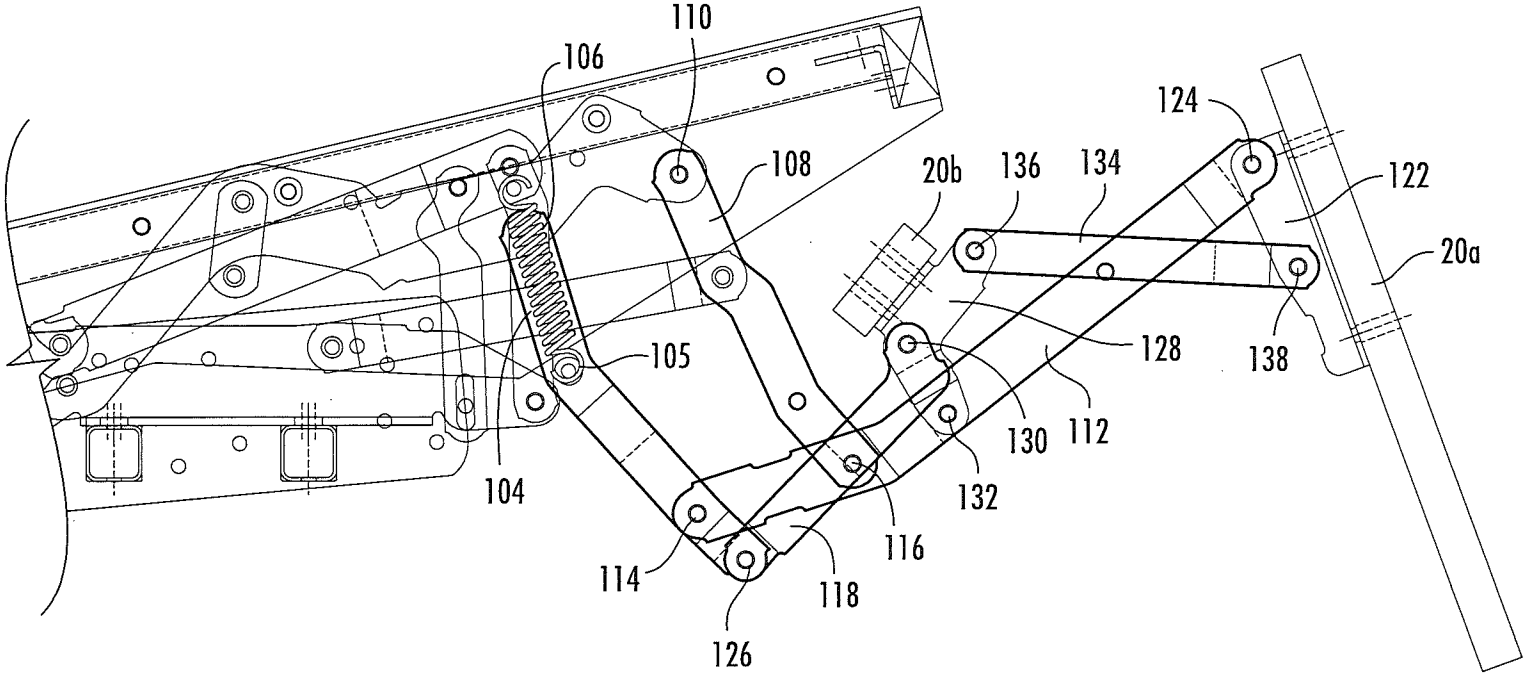
Figure 12:
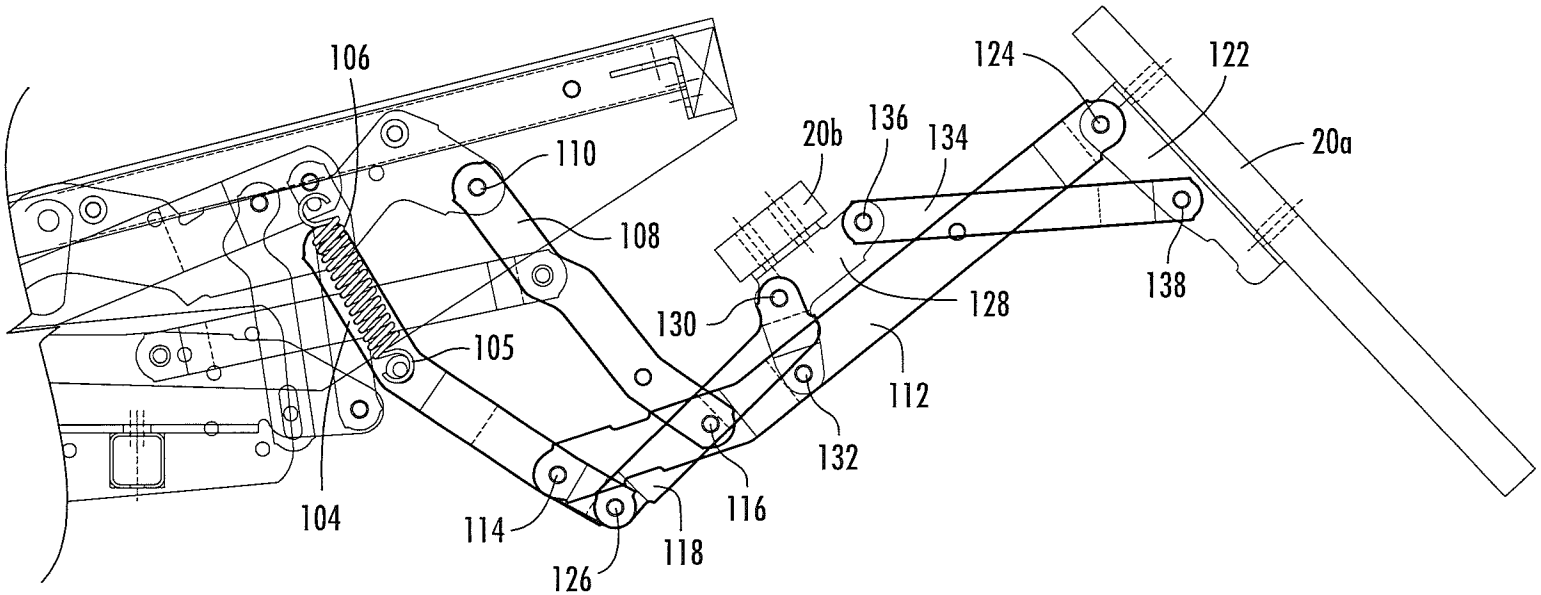
Figure 13:
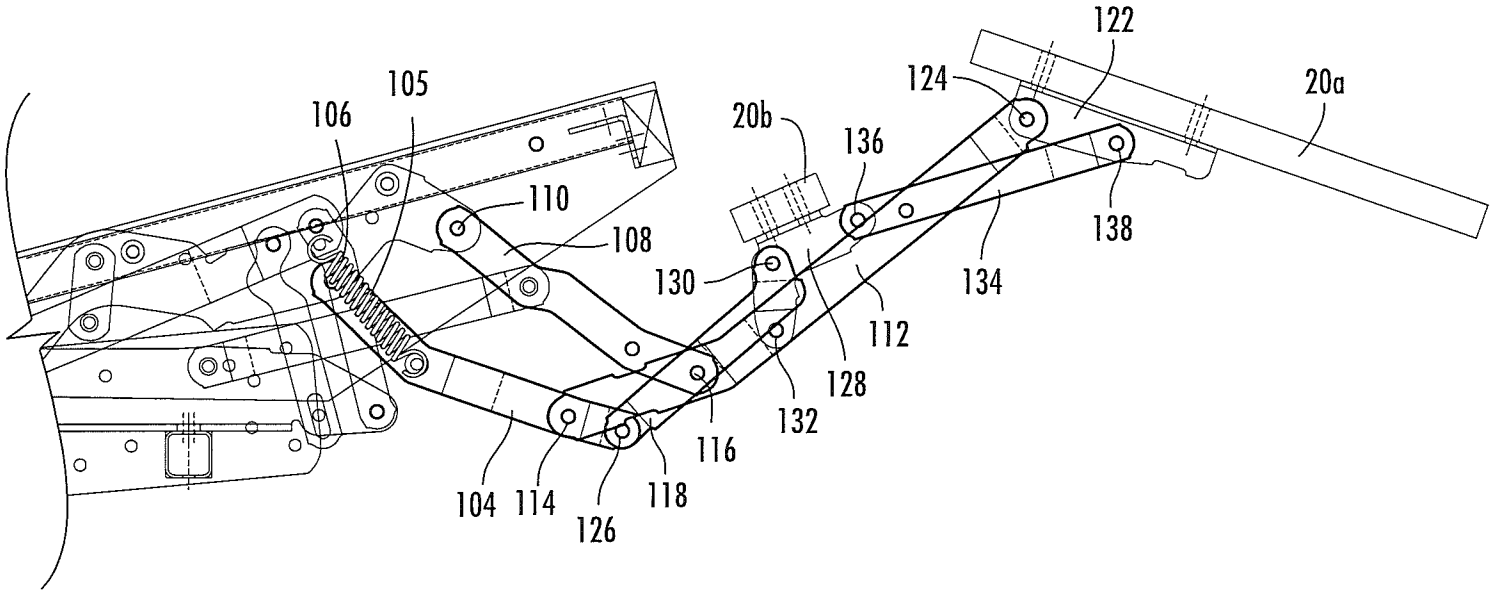
Figure 14:
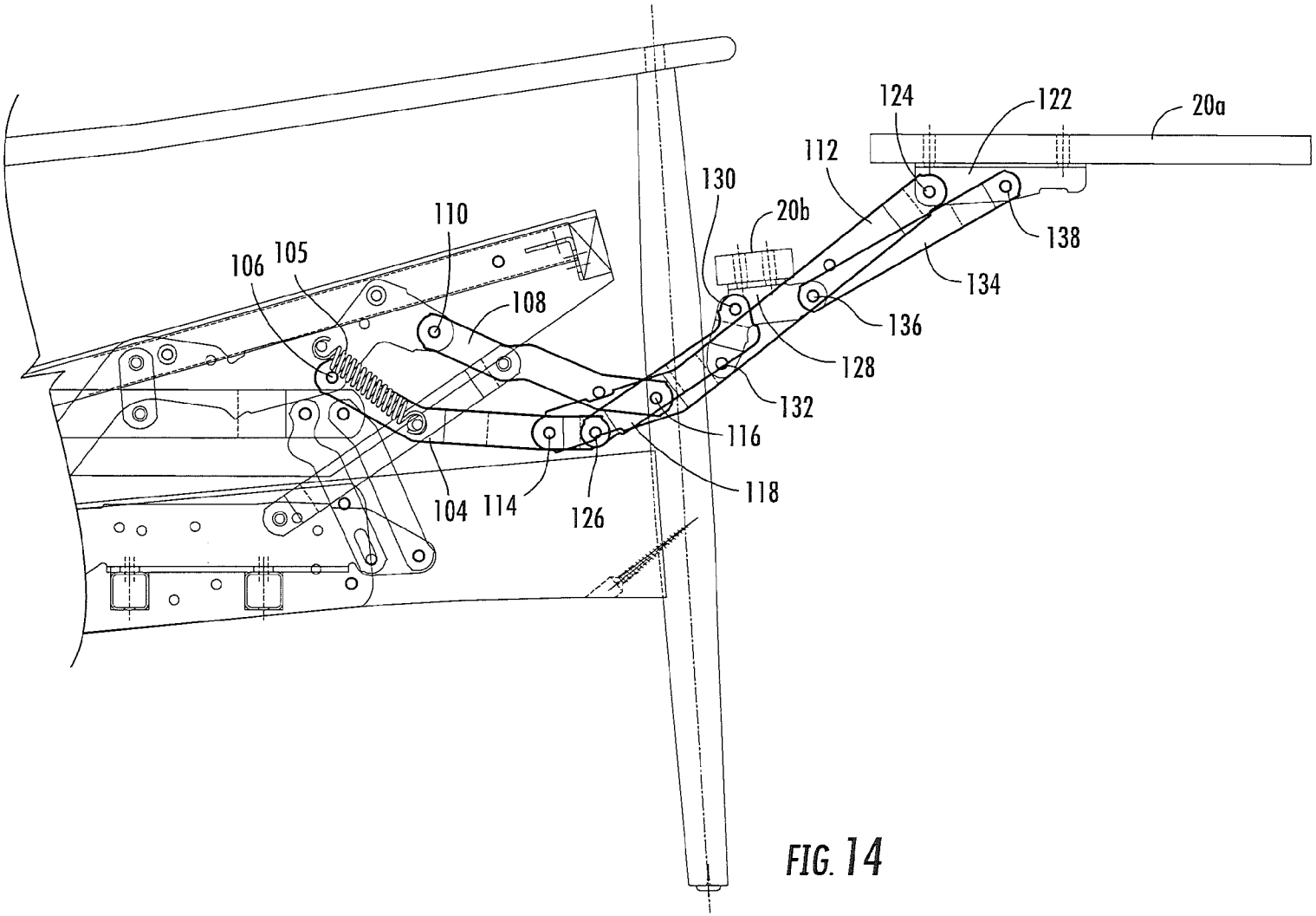

Operation of the chair 10 typically begins in the upright position (FIG. 2). In the upright position, the ottomans 20*a*, 20*b* are folded beneath the seat 16. The main ottoman 20*a* is positioned beneath the front portion of the seat 16 and is generally horizontally disposed and facing downwardly (in the illustrated embodiment, the main ottoman 20*a* forms an angle δ of between about 20 and 30 degrees with the underlying surface). The main ottoman 20*a* is relatively long (i.e., between about 8 and 12 inches from its front edge to its rear edge, as shown by dimension L in FIG. 6). Notably, the lowermost point of the main ottoman 20*a* is at a height H of between about 6 and 9 inches above the underlying surface, such that, in the upright position, the main ottoman 20*a* is largely, if not entirely, hidden from view when observed from the side, even with a high leg chair, such as that illustrated, that has a considerable gap between the arm panel 14 and the floor. The rear ottoman 20*a* is generally vertically disposed and positioned above the rearward edge of the main ottoman 20*a*. The links comprising the footrest linkage 150 of the reclining mechanism 21 are folded beneath the seat 16. The seat 16 typically has a pitch angle β of between about 5 and 8 degrees relative to horizontal, and the backrest 18 has a first backrest angle α of between about 100 and 120 degrees relative to the seat 16. The reclining mechanism 21 is maintained in place by tension in the spring 105, which urges the reclining mechanism 21 toward the upright position.

Figure 3:
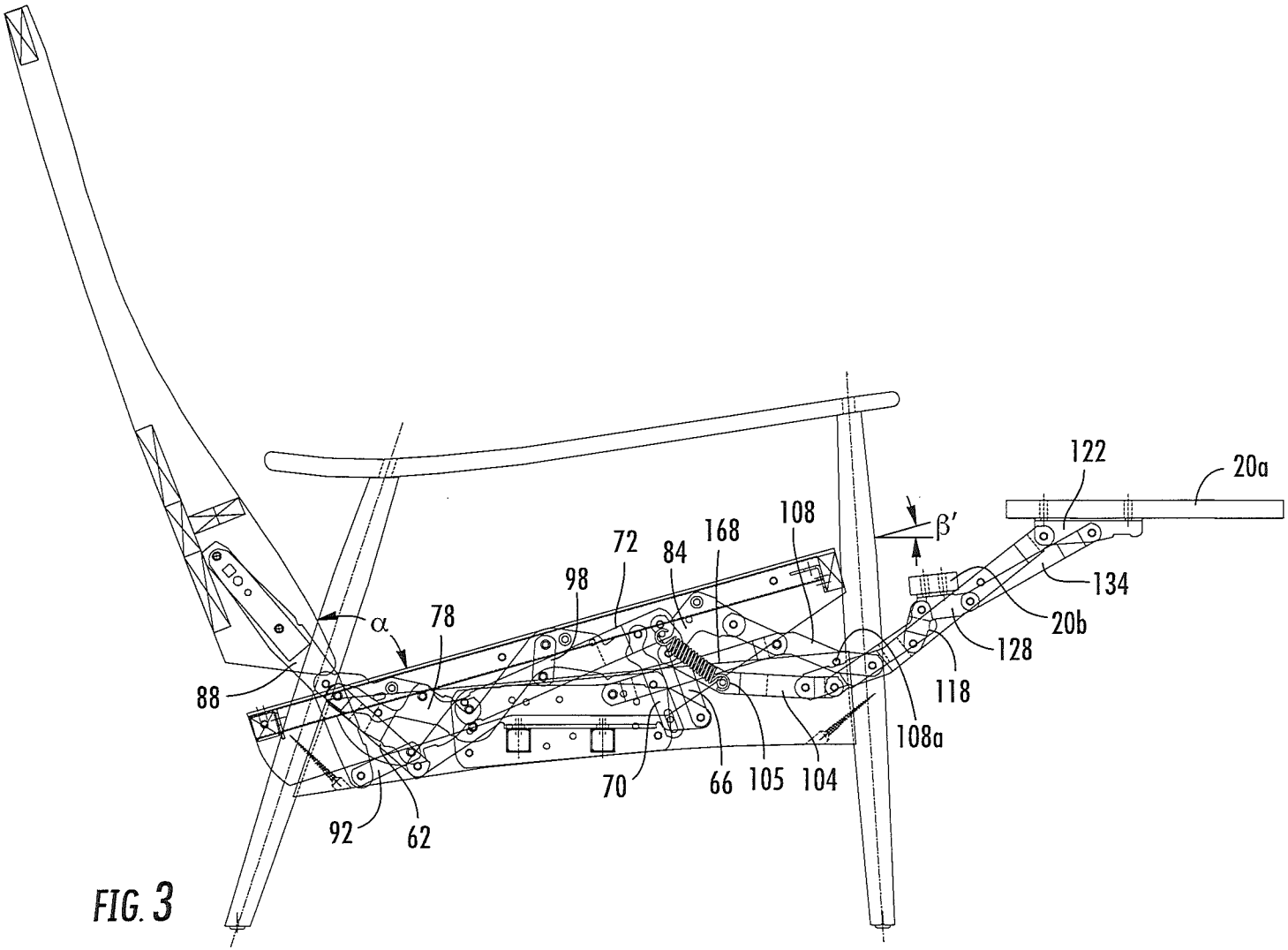
FIG. 3 is a cutaway side view of the chair of FIG. 1 showing the chair in its TV position.

To move the chair 10 to the TV position of FIG. 3, the occupant of the chair 10 pushes forwardly on the arms 29, which action forces the occupant's back rearwardly into the backrest 18. Forcing the backrest 18 and seat 16 rearwardly relative to the frame 12 draws the seat 16 and seat panel 84 rearwardly and causes the seat 16 to take a pitch angleβ'with the floor; this movement is largely controlled by the rear swing link 62, the front swing link 66, and the sequencer link 70. Rearward movement of the seat 16 also forces the backrest 18 rearwardly relative to the frame 12 and rotates the backrest 18 very slightly counterclockwise. However, the backrest 18 substantially retains the first backrest angle α between it and the seat 16 observed in the upright position of FIG. 2. In addition, rearward movement of the seat 16 draws the transition plate 78 rearward. This movement rotates the rear swing link 62 counterclockwise about the pivot 64 and draws the connecting link 72 rearwardly. As a result, the front swing link 66 and the sequencer link 70 rotate counterclockwise about their respective pivots 68, 60*a* (the sequencer link 70 also rises slightly relative to the pin 60*a* in its slot 70*a*, such that the pin 60*a* is in the center of the slot 70*a*).

The rearward movement of the seat 16 also drives the footrest linkage 150 to extend. As the seat 16 moves rearwardly, the drive link 168 rotates only slightly, with the net effect that the front ottoman drive link 108 rotates counterclockwise considerably about the pivot 110. This action also extends the rear ottoman extension link 112 and the auxiliary ottoman extension link 118, which in turn rotates the rear ottoman drive link 104 counterclockwise about the pivot 106. Once rotation of the rear ottoman drive link 104 causes the axis defined by the spring 105 to pass the pivot 106, the spring 105 then urges the rear ottoman drive link 104 toward the TV position.

As can be seen in the sequential views of FIGS. 6-14, as the rear ottoman drive link 104 rotates, it drives the both the rear ottoman extension link 112 and the auxiliary ottoman extension link 118 forward. Movement of the auxiliary ottoman extension link 118 relative to the rear ottoman extension link 112 causes the auxiliary ottoman bracket 128 to rotate clockwise about the pivot 132. This rotation drives the main ottoman extension link 134 forward relative to the rear ottoman extension link 112, thereby causing the main ottoman 20*a* to rotate counterclockwise toward the horizontal disposition of FIGS. 3, 4 and 14. The rotation of the auxiliary ottoman bracket 128 also rotates the auxiliary ottoman 20*b* to a horizontal disposition. Extension of the footrest linkage 150 ceases when a pin 108*a* on the front ottoman drive link 108 strikes the upper edge of the rear ottoman extension link 112.

As can be seen in the sequential views of FIGS. 6-14, the inclusion of the auxiliary ottoman extension link 118, the auxiliary ottoman bracket 128, and the main ottoman extension link 134 can enable the main ottoman 20*a* to extend in a manner that allows the use of a wide/deep ottoman, even with a high leg-style chair. More specifically, a conventional footrest linkage includes a single front ottoman extension link that acts in conjunction with the rear ottoman extension link to extend and rotate the main ottoman (see, e.g., U.S. Pat. No. 8,016,348 to Hoffman et al.), wherein the main ottoman is typically perpendicular to the floor in the upright position and serves as a front panel of the chair. In contrast, in the footrest linkage 150, the auxiliary ottoman extension link 118, the auxiliary ottoman bracket 128, and the main ottoman extension link 134 combine to replace a conventional front ottoman extension link to extend and rotate the main ottoman 20*a* (in conjunction with the rear ottoman extension link 112). Using three links rather than one enables the main ottoman 20*a* to (a) be folded more tightly with the rest of the reclining mechanism 21 in the upright position (i.e., in a configuration that is rather short from top to bottom), and in particular to face generally downwardly in a location that is well off of the underlying surface, yet (b) still extend to a comfortable distance in front of the seat 16 in the TV position. The position of the ottoman 20*a* in the upright position enables the ottoman 20*a* to be largely, if not entirely, hidden from view in the upright position, even if the reclining mechanism 21 is employed with a high leg chair style (such as that of the chair 10) that has considerable open space beneath the seat.

In addition, the geometry of the auxiliary ottoman extension link 118, the auxiliary ottoman bracket 128, and the main ottoman extension link 134 allows a large main ottoman 20*a* to be employed. In a conventional footrest linkage that uses a single front ottoman extension bracket, the designer is faced with the issue of sufficient extension of the ottoman in front of the seat in order to provide a comfortable support surface for the feet of an occupant. However, with an ottoman such as that of the chair 10 that folds beneath the seat well off the underlying surface, not only must the main ottoman 20*a* be extended well forward of the seat 16 in order to provide a comfortable support surface for the occupant, the footrest linkage 150 must also unfold in such a way that the main ottoman 20*a* does not strike the underlying surface as it unfolds.

These functions are accomplished in the chair 10. As the rear and front ottoman drive links 104, 108 rotate and force the rear ottoman extension link 112 forward, the auxiliary ottoman extension link 118 also moves forward and rotates clockwise relative to the rear ottoman drive link 104 about the pivot 126. However, the use of the auxiliary ottoman extension link 118, the auxiliary ottoman bracket 128, and the main ottoman extension bracket 134 and the geometry of their pivot points causes the main ottoman 20*a* to rotate counterclockwise about the pivot 124 relatively slowly compared to the rotation of the front and rear ottoman drive links 108, 104. This reduced rotation of the main ottoman 20*a* enables the main ottoman 20*a* to be located well in front of the seat 16, with its upper edge raised slightly, before it rotates to a substantially vertical position (see FIG. 10). The rotation of the ottoman 20*a* is substantially more rapid after the main ottoman 20*a* reaches its vertical disposition.

To be more specific, the front and rear ottoman drive links 108, 104 rotate counterclockwise approximately 120 degrees in moving from the upright to the TV position. This action drives the main ottoman 20*a* to rotate approximately 150 degrees. However, the front and rear ottoman drive links 108, 104 rotate about 70 degrees (more than half of their total rotation) in order to move the main ottoman 20*a* to the substantially vertical orientation of FIG. 10 (a rotation of the main ottoman 20*a* of only about 60 degrees, which is considerably less than half of its total rotation). In this vertical orientation, the main ottoman 20*a* is positioned about 4 to 8 inches, and in some embodiments about 5 to 7 inches, in front of the seat 16. Conversely, to move the main ottoman 20*a* from the substantially vertical orientation of FIG. 10 to the TV position of FIGS. 3 and 14, the front and rear ottoman drive links 108, 104 rotate counterclockwise only about another 50 degrees, but the main ottoman 20*a* rotates another 90 degrees. This "accelerated" rotation of the main ottoman 20*a* during the last portion of its movement is possible because of the replacement of a single ottoman extension link with the auxiliary ottoman extension link 118, the auxiliary ottoman bracket 128, and the main ottoman extension link 134.

In addition, the geometry of the auxiliary ottoman extension link 118, the auxiliary ottoman bracket 128, and the main ottoman extension link 134 permits the inclusion of the auxiliary ottoman 20*b*. Many recliners strive to avoid the presence of sizable gaps between the seat and any ottomans as a safety concern; generally speaking, gaps of greater than 5 inches by 5 inches are disfavored. This issue is typically addressed by the inclusion of one or more additional ottomans, such as the auxiliary ottoman 20*b*. However, such an ottoman must be able to retract into and extend from a position beneath the seat 16 that does not interfere with the movement of the reclining mechanism 21 or the detract from the appearance of the chair 10. The use of the auxiliary ottoman extension link 118, the auxiliary ottoman bracket 128, and the main ottoman extension link 134 allows the auxiliary ottoman 20*a* to reside between the seat 16 and the main ottoman 20*b* in the upright position, yet extend to a location in front of the seat 16 and rearward of the main ottoman 20*b* in the TV and upright positions.

To move the chair 10 to the fully reclined position of FIG. 4, the occupant again pushes forwardly on the arms 29, which forces the occupant's back into the backrest 18. This action forces the backpost 88 and the backrest 18 to rotate counterclockwise about the pivot 90 and move to a reclined position relative to the seat 16. Rotation of the backpost 88 drives the drive link 92 forwardly, which in turn causes the transition plate 78 to rotate counterclockwise about the pivot 89. Rotation of the transition plate 78 drives the seat panel 84 upwardly. As the seat panel 84 rises, through the control link 98 it pulls the connecting link 72 upwardly and rotates it clockwise about the pivot 76. Rotation ceases when an edge of the transition plate 78 contacts a pin on the seat panel 84. In this position, the backrest 18 typically reclines at a second backrest angle $\alpha'$ of between about 115 and 135 degrees relative to the seat 16.

The chair 10 can be returned to the TV and/or upright position by the occupant pushing downwardly with his feet on one or more of the ottomans 20*a*, 20*b* or pulling forwardly on the arms 29. The links of the reclining mechanism 21 will reverse the various movements described above.

Those skilled in this art will recognize that the reclining mechanism 21 may be employed with a variety of reclining seating units, including sofas and sectional units, including those that have fewer ottomans. Also, the reclining mechanism may be employed with seating units that actuate in different ways, such as handles, release levers, and the like.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A reclining seating unit, comprising:

a base configured to rest on an underlying surface;

a seat;

a backrest;

an ottoman; and a reclining mechanism comprising a plurality of pivotally interconnected links and attached to the base, seat, backrest and ottoman, the reclining mechanism configured to move the seat, backrest and ottoman relative to the base between (a) an upright position, in which the backrest is generally upright, the seat is generally horizontal, and the ottoman is positioned beneath the seat and faces generally downwardly, (b) a TV position, in which the backrest is generally upright and the ottoman is generally horizontally disposed in front of the seat, and (c) a fully reclined position, in which the ottoman remains generally horizontally disposed in front of the seat and the backrest takes a shallower angle relative to the seat than in the upright and TV positions;

wherein the ottoman is between about 8 and 12 inches in length; and wherein, in moving from the upright to the TV position, the ottoman passes through an intermediate position in which it is vertically disposed, and wherein the ottoman is between about 4 and 8 inches in front of the seat in this intermediate position.

2. The seating unit defined in claim 1, wherein a lowermost point of the ottoman is at least 6 inches from the underlying surface when the seating unit is in the upright position.

3. The seating unit defined in claim 1, wherein the base includes legs and an arm panel that define a gap between the underlying surface and the arm panel, wherein the gap is at least 5 inches in height when the seating unit is in the upright position.

4. The seating unit defined in claim 1, wherein the reclining mechanism is actuated to move from the upright position to the TV position by an occupant of the seating unit pushing rearwardly on at least one of the backrest and the seat.

5. The seating unit defined in claim 1, wherein the reclining mechanism includes a footrest linkage, and wherein the footrest linkage comprises:

front and rear ottoman drive links pivotally attached to the seat;

a rear ottoman extension link pivotally attached to the front and rear ottoman drive links;

an auxiliary ottoman extension link pivotally attached to the rear ottoman drive link;

an auxiliary ottoman bracket pivotally attached to the auxiliary ottoman extension link and to the rear ottoman extension link;

a main ottoman extension link pivotally attached to the auxiliary ottoman bracket; and a main ottoman bracket to which the ottoman is mounted, the main ottoman bracket being pivotally attached to the rear ottoman extension link and to the main ottoman extension link.

6. The seating unit defined in claim 5, wherein the ottoman is a main ottoman, and further comprising an auxiliary ottoman mounted on the auxiliary ottoman bracket that is positioned between the main ottoman and the seat when the seating unit is in the TV and fully reclined positions.

7. The seating unit defined in claim 5, wherein a first pivot connecting the rear ottoman extension link and the rear ottoman drive link is positioned intermediate of (a) a second pivot connecting the rear ottoman drive link and the seat and (b) a third pivot connecting the rear ottoman drive link and the auxiliary ottoman extension link.

8. A reclining seating unit, comprising:

a base configured to rest on an underlying surface;

a seat;

a backrest;

an ottoman; and a reclining mechanism comprising a plurality of pivotally interconnected links and attached to the base, seat, backrest and ottoman, the reclining mechanism configured to move the seat, backrest and ottoman relative to the base between (a) an upright position, in which the backrest is generally upright, the seat is generally horizontal, and the ottoman is positioned beneath the seat and faces generally downwardly, (b) a TV position, in which the backrest is generally upright and the ottoman is generally horizontally disposed in front of the seat, and (c) a fully reclined position, in which the ottoman remains generally horizontally disposed in front of the seat and the backrest takes a shallower angle relative to the seat than in the upright and TV positions;

wherein a lowermost point of the ottoman is at least 6 inches from the underlying surface when the seating unit is in the upright position;

wherein the ottoman is a main ottoman, and further comprising an auxiliary ottoman that is positioned between the main ottoman and the seat when the seating unit is in the TV and fully reclined positions and that, in the upright position, is positioned rearwardly of a front edge of the main ottoman and above a rear edge of the main ottoman.

9. The seating unit defined in claim 8, wherein the base includes legs and an arm panel that define a gap between the underlying surface and the arm panel, wherein the gap is at least 5 inches in height when the seating unit is in the upright position.

10. The seating unit defined in claim 8, wherein the reclining mechanism is actuated to move from the upright position to the TV position by an occupant of the seating unit pushing rearwardly on at least one of the backrest and the seat.

11. The seating unit defined in claim 8, wherein the reclining mechanism includes a footrest linkage, and wherein the footrest linkage comprises:

front and rear ottoman drive links pivotally attached to the seat;

a rear ottoman extension link pivotally attached to the front and rear ottoman drive links;

an auxiliary ottoman extension link pivotally attached to the rear ottoman drive link;

an auxiliary ottoman bracket to which the auxiliary ottoman is mounted that is pivotally attached to the auxiliary ottoman extension link and to the rear ottoman extension link;

a main ottoman extension link pivotally attached to the auxiliary ottoman bracket; and a main ottoman bracket to which the main ottoman is mounted, the main ottoman bracket being pivotally attached to the rear ottoman extension link and to the main ottoman extension link.

12. The seating unit defined in claim 11, wherein a first pivot connecting the rear ottoman extension link and the rear ottoman drive link is positioned intermediate of (a) a second pivot connecting the rear ottoman drive link and the seat and (b) a third pivot connecting the rear ottoman drive link and the auxiliary ottoman extension link.

13. The seating unit defined in claim 12, wherein, in moving from the upright to the TV position, the main ottoman passes through an intermediate position in which it is vertically disposed, and wherein the main ottoman is between about 4 and 8 inches in front of the seat in this intermediate position.

14. A reclining seating unit, comprising:

a base configured to rest on an underlying surface;

a seat;

a backrest;

an ottoman; and a reclining mechanism comprising a plurality of pivotally interconnected links and attached to the base, seat, backrest and ottoman, the reclining mechanism configured to move the seat, backrest and ottoman relative to the base between (a) an upright position, in which the backrest is generally upright, the seat is generally horizontal, and the ottoman is positioned beneath the seat and faces generally downwardly, (b) a TV position, in which the backrest is generally upright and the ottoman is generally horizontally disposed in front of the seat, and (c) a fully reclined position, in which the ottoman remains generally horizontally disposed in front of the seat and the backrest takes a shallower angle relative to the seat than in the upright and TV positions;

wherein the reclining mechanism includes a footrest linkage, and wherein the footrest linkage comprises:

front and rear ottoman drive links pivotally attached to the seat;

a rear ottoman extension link pivotally attached to the front and rear ottoman drive links;

an auxiliary ottoman extension link pivotally attached to the rear ottoman drive link;

an auxiliary ottoman bracket pivotally attached to the auxiliary ottoman extension link and to the rear ottoman extension link;

a main ottoman extension link pivotally attached to the auxiliary ottoman bracket; and a main ottoman bracket to which the ottoman is mounted, the main ottoman bracket being pivotally attached to the rear ottoman extension link and to the main ottoman extension link.

15. The seating unit defined in claim 14, wherein the ottoman is a main ottoman, further comprising an auxiliary ottoman mounted on the auxiliary ottoman bracket that is positioned between the main ottoman and the seat when the seating unit is in the TV and fully reclined positions.

16. The seating unit defined in claim 14, wherein a first pivot connecting the rear ottoman extension link and the rear ottoman drive link is positioned intermediate of (a) a second pivot connecting the rear ottoman drive link and the seat and (b) a third pivot connecting the rear ottoman drive link and the auxiliary ottoman extension link.

17. The seating unit defined in claim 16, wherein, in moving from the upright to the TV position, the ottoman passes through an intermediate position in which it is vertically disposed, and wherein the ottoman is between about 4 and 8 inches in front of the seat in this intermediate position.

18. The seating unit defined in claim 14, wherein the base includes legs and an arm panel that define an gap between the underlying surface and the arm panel, wherein the gap is at least 5 inches in height when the seating unit is in the upright position.

19. The seating unit defined in claim 14, wherein the reclining mechanism is actuated to move from the upright position to the TV position by an occupant of the seating unit pushing rearwardly on at least one of the backrest and the seat.

* * * * *